US010407960B2

(12) United States Patent
Wolfe

(10) Patent No.: US 10,407,960 B2
(45) Date of Patent: Sep. 10, 2019

(54) AUTOMATICALLY ACTUATED DOOR LOCK SYSTEM

(71) Applicant: ASSA ABLOY Entrance Systems AB, Landskrona (SE)

(72) Inventor: Jeffrey A. Wolfe, Matthews, NC (US)

(73) Assignee: ASSA ABLOY ENTRANCE SYSTEMS AB, Landskrona (SE)

( * ) Notice: Subject to any disclaimer, the term of this patent is extended or adjusted under 35 U.S.C. 154(b) by 358 days.

(21) Appl. No.: 15/424,592

(22) Filed: Feb. 3, 2017

(65) Prior Publication Data

US 2018/0223573 A1 Aug. 9, 2018

(51) Int. Cl.

| | |
|---|---|
| ***E05D 15/00*** | (2006.01) |
| ***E05D 15/06*** | (2006.01) |
| ***E06B 3/46*** | (2006.01) |
| ***E05B 47/00*** | (2006.01) |
| ***E05B 65/00*** | (2006.01) |
| ***E05D 15/08*** | (2006.01) |
| ***E06B 3/50*** | (2006.01) |

(52) U.S. Cl.

CPC ..... *E05D 15/0621* (2013.01); *E05B 47/004* (2013.01); *E05B 65/0085* (2013.01); *E05D 15/08* (2013.01); *E06B 3/469* (2013.01); *E06B 3/4636* (2013.01); *E06B 3/509* (2013.01); *E05Y 2900/132* (2013.01)

(58) Field of Classification Search

CPC ..... E06B 3/4636; E06B 3/485; E06B 3/487; E06B 3/5009; E06B 3/5054; E06B 3/5072; E06B 3/509; E06B 3/469; E05D 15/08; E05D 15/0604; E05D 15/48; E05D 15/56; E05D 15/58; E05D 15/581; E05D 2015/485; E05D 2015/586; E05D 2015/587; E05D 2015/588; E05B 47/004; E05B 65/0085; E05B 65/08; E05B 65/0811; E05B 65/0817; E05Y 2900/132

See application file for complete search history.

(56) References Cited

U.S. PATENT DOCUMENTS 1,852,608 A * 4/1932 Grable ..... E06B 3/922 160/211
2,833,346 A * 5/1958 Preston ..... E06B 3/4654 160/197
2,895,183 A * 7/1959 Dumbolton ..... E05D 15/08 160/197
3,348,603 A * 10/1967 Ford ..... E06B 3/4609 160/197

(Continued)

*Primary Examiner* — Johnnie A. Shablack
(74) *Attorney, Agent, or Firm* — Sheridan Ross P.C.

(57) ABSTRACT

A door package or door assembly includes multiple door panels. A top frame member has one or more tracks upon which one or more door panels may slide relative to a door opening to close the door opening when in a fully extended position and to open the doorway when in a retracted position. When in its retracted or open position, a plurality of door panels may also pivot about a pivot plate attached to the floor to a broken open position essentially perpendicular to the plane of the doorway opening. Upper and lower magnetic latch assemblies automatically decouple to permit pivoting of the entire door panel assembly when the panels are fully retracted, and when the panels are not fully retracted, are automatically actuated to prevent pivoting of the door panel assembly.

32 Claims, 12 Drawing Sheets

(56) References Cited

U.S. PATENT DOCUMENTS 3,750,737 A * 8/1973 Woodward ..... A47K 3/34 160/202
3,911,991 A * 10/1975 Malferrari ..... A47H 1/04 160/197
4,305,227 A * 12/1981 Georgelin ..... E05D 15/48 49/141
4,484,761 A * 11/1984 Knabel ..... A63C 9/0802 280/612
4,619,074 A * 10/1986 Leung ..... E05D 15/58 49/125
4,635,699 A * 1/1987 Kauffman ..... B23Q 11/0825 160/211
4,648,638 A * 3/1987 McKnight ..... E05B 53/001 292/144
5,109,910 A * 5/1992 Tortorella ..... A47H 15/04 160/197
5,832,980 A * 11/1998 Cianciolo ..... E05D 15/58 160/197
6,039,516 A * 3/2000 Diels ..... B23Q 11/0825 160/202
6,161,334 A * 12/2000 Goodin ..... A01K 1/0017 160/211
6,170,195 B1 * 1/2001 Lim ..... E05D 15/58 49/141
6,422,287 B1 * 7/2002 Wilke ..... E05D 15/58 160/195
6,526,695 B1 * 3/2003 Nguyen ..... E05D 7/1005 49/141
6,892,783 B1 * 5/2005 Comeau ..... A47H 1/08 160/126
6,990,771 B2 * 1/2006 Pfaff ..... E05F 17/00 160/197
7,174,944 B1 * 2/2007 Clark ..... E05D 15/063 16/96 R
7,299,852 B1 * 11/2007 Chuang ..... A47H 15/04 160/197
7,451,802 B2 * 11/2008 Cianciolo ..... E05D 15/08 160/210
7,458,410 B1 * 12/2008 Bronner ..... E05D 15/0656 160/197
7,533,502 B2 * 5/2009 Siegel ..... E04B 2/827 160/200
7,861,475 B2 * 1/2011 Sprague ..... E04B 2/827 160/196.1
7,950,439 B2 * 5/2011 Anderson ..... E05D 15/58 160/195
7,958,926 B2 * 6/2011 Colson ..... E06B 9/36 160/168.1 V
8,096,342 B2 1/2012 Scruggs
8,261,500 B2 * 9/2012 Sprague ..... E04B 2/827 160/200
8,387,541 B2 * 3/2013 Losito ..... B61B 1/02 104/28
8,800,206 B2 * 8/2014 Vaknin ..... E05D 15/06 49/358
8,806,807 B2 * 8/2014 Rees ..... E05D 15/48 49/130
8,993,898 B2 * 3/2015 Weibler ..... A61B 5/0046 174/365
9,032,588 B2 * 5/2015 Chen ..... E06B 7/28 16/106
9,038,240 B2 * 5/2015 Chen ..... E05D 15/063 16/106
9,371,680 B2 * 6/2016 Finke ..... E05F 15/643
9,376,849 B2 * 6/2016 Lim ..... E06B 3/481
9,422,747 B2 * 8/2016 Rodan ..... E05D 15/06
9,532,659 B2 * 1/2017 Tsui ..... A47F 3/005
9,562,371 B2 * 2/2017 McCaslin ..... E05B 47/0046
10,111,538 B2 * 10/2018 Weiss ..... A47F 3/0434
2005/0241781 A1 * 11/2005 Johnson ..... E05F 15/50 160/199
2008/0054648 A1 * 3/2008 Baragano Gonzalez ..... E05B 47/0002 292/71
2009/0241445 A1 * 10/2009 Sprague ..... E04B 2/827 52/243.1
2009/0250176 A1 * 10/2009 Ryan ..... E04B 2/7425 160/185
2010/0242366 A1 * 9/2010 Liebscher ..... E05D 15/58 49/142
2012/0031001 A1 * 2/2012 Dorr ..... E05B 65/0811 49/54
2012/0085502 A1 * 4/2012 Berry ..... E06B 3/80 160/127
2012/0192493 A1 * 8/2012 Wolfe ..... E05B 47/0046 49/449
2014/0068853 A1 * 3/2014 Opwald ..... A47K 3/362 4/607
2014/0352220 A1 * 12/2014 Rees ..... H04N 1/00 49/164
2015/0284949 A1 * 10/2015 Hilliaho ..... E06B 3/924 52/204.1
2015/0330126 A1 * 11/2015 Ma ..... E05B 53/003 292/32
2016/0312515 A1 * 10/2016 Rodan ..... E05D 15/06
2016/0376821 A1 * 12/2016 Ward ..... E05B 63/0052 49/394

* cited by examiner

AUTOMATICALLY ACTUATED DOOR LOCK SYSTEM

RELATED APPLICATION

The subject matter of the present disclosure is related to the content of U.S. Pat. No. 8,096,342 issued Jan. 17, 2012, the entirety of which is incorporated herein by reference.

FIELD OF THE INVENTION

The present application is directed to an automatically actuated lock or latch system used in connection with sliding or telescoping door panels that permits multiple door panels both to slide relative to each other in typical operating fashion and swing or pivot in combination increasing the doorway opening capability. While a primary end use for embodiments of the present application are patient room doorways in hospitals, including intensive care unit rooms, aspects of the present disclosure may be used in many other end use applications. In one embodiment, the system utilizes interacting magnets to couple and decouple door latching assemblies.

BACKGROUND OF THE INVENTION

Sliding or telescoping door systems have many applications. When the individual panels of a door system or door package are in a fully retracted position, the panels are typically aligned in an adjacent and parallel orientation at a position adjacent to either the left or right door jamb and the doorway is deemed open for normal ingress and egress, although the panels continue to block a portion of the doorway. When the individual panels are in a fully extended position, the panels extend across the doorway, marginally overlapping along adjacent ends, and the doorway is closed. In some situations, including but not limited to hospital environments and, more particularly, intensive care units, occasionally the need arises to increase the size of the doorway opening and to do so in as quick and efficient manner as possible and to do so in a manner that reduces the potential spread of germs.

U.S. Pat. No. 8,096,342 discloses a door package system that eliminates a floor-based track system for sliding and telescoping door panel packages minimizing the collection of bacteria and other types of debris and thereby providing a cleaner environment. The door package system is also capable of full breakout meaning, when the individual door panels are retracted, the door panels may pivot or swing in unison about the ends adjacent the door jamb to further enlarge the opening of the doorway. An enlarged opening permits greater access to the room, facilitates ingress and egress of patient beds, other large equipment and/or hospital staff. However, this system also involves manual actuation of a sliding door lock to decouple the door panels from the overhead sliding track and from each other to allow the panels to pivot or swing open. More specifically, lock rod 512 extending to the bottom of the door panel must be manually removed from hole 514 in the swing arm 210 to permit the swing arm 210 to separate. A companion lock rod, not shown in U.S. Pat. No. 8,096,342, typically extending vertically to the top of the door panel also would need to be repositioned to decouple the door panels from the top portion of the door frame including the overhead sliding mechanism. The manual actuation of these latch mechanisms increases the risk of spreading germs, requires personnel to know where the manual latch mechanisms are located and how to operate them, and increases the time to move the door package into a full breakout position.

SUMMARY OF THE INVENTION

According to aspects of the present disclosure, a door lock system is disclosed for use with door packages having sliding or telescoping door panels. The door lock system may include one or both of a lower latch assembly and an upper latch assembly. The lower and upper latch assemblies are magnetically actuated such that the latch assemblies automatically unlock or decouple when the door panels are in a fully retracted position and automatically lock or engage or couple when the door panels are at least partially extended from a fully retracted position. With an automated actuation system, a person handling the door panels may move the panels from a fully retracted position to a fully broken open position without having to manually unlock or disconnect any locking mechanism, thereby saving time and potentially saving lives. Eliminating the manual actuation of a latching system also reduces the potential for spreading germs. In the fully broken open position, the door panels are essentially perpendicular to the plane of the doorway opening. In the case of a hospital room the additional opening space enhances access and the ability to move patient beds and equipment in and out of the room quickly and efficiently. Automatic decoupling of any latch mechanism saves time and, by eliminating a manual coupling, eliminates a location where germs may be spread.

A two-panel door panel assembly where one of the panels slides and the other remains stationary is sometimes referred to as a single-slide package, and a door panel assembly comprising three or more panels where one panel remains stationary and the other panels slide is sometimes referred to as a telescoping package. The present application relates to both single slide and telescoping door packages, as well as variations of these, including bi-part door packages. The door panels can be made of glass to be transparent or translucent, or may be made of any other suitable material, including metal, composites, plastic, wood and/or combinations of these materials, and need not be translucent or transparent. The door panels may also be of various sizes in height, width and thickness.

A door package also typically includes a frame, including a top portion and two side portions. The side portions attach to the left and right door jambs and may be optional. When the panels are in a fully retracted position the panels are adjacent to a first side portion or first door jamb and the doorway is considered open. When the panels are in a fully extended position, the panel that extends the farthest is adjacent to the opposite side portion or door jamb and the doorway is considered closed. The door panel that extends the farthest from the retracted position may also include a door handle and a latching mechanism that secures the door panel to the side portion of the frame or to the door jamb. Depending upon the number of door panels and the type of door package, at least one track is positioned in the top portion of the frame for at least one door panel to slide back and forth across the opening of the doorway, such as in the case of a single-slide package. Multiple tracks may be included in a telescoping package and a bi-part package. A trolley or carriage interconnects each sliding panel to the track positioned in the top portion of the frame.

According to aspects of the present disclosure, an automatically actuated upper latch assembly may include a pivoting latch arm that moves between a first position and a second position, wherein in one position the latch arm interacts with a catch member and in the other position the latch arm is retracted and cannot interact with the catch member. In one embodiment, the catch member is part of a carriage and the latch arm is associated with a door panel. When the latch member is in the extended position, the interaction between the latch member and the catch member maintains alignment of the door panel and the carriage, allowing the door panel and carriage to slide relative to a track in the top frame of the door package, and prevents the door panel from pivoting relative to the carriage and out of the plane of the doorway. The upper latch assembly may be positioned adjacent to or along the upper edge of a first door panel and the catch member may be positioned at any location on or in association with the carriage that allows the latch member to interact with the catch member. The positions of the latch member and catch member may be reversed. When the latch member is in a retracted position it does not interface or interact with the catch member. As a result, the panel can pivot relative to the carriage and out of the plane of the doorway into a fully broken out position.

According to aspects of the present disclosure, in one embodiment, the upper latch assembly further includes a first magnet associated with the latch member and a second magnet disposed in an adjacent door panel. The first and second magnets have associated magnetic characteristics including strength and flux pattern. The flux pattern includes the size, shape and orientation of the magnetic field of the magnet. When the adjacent door panels are in a fully retracted position, the first and second magnets will be positioned sufficiently near or proximate each other that the interaction of the magnetic fields of the two magnets causes the latch arm to move from the first position to the second position. Conversely, when the first and second magnets are not sufficiently proximate to each other, i.e., when one door panel slides away from the adjacent door panel, the interaction of the respective magnetic fields is lost or weakened such that the latch arm returns to its first position. The latch arm may be weighted in a manner that causes the latch arm to change positions once the strength of the interacting magnetic fields is reduced below a threshold value. Alternatively, a biasing member may be included to influence the return of the latch arm to its first position. Any type of biasing member known to those of skill in the art could be used for this purpose and each such biasing member is deemed within the scope of the present disclosure.

According to aspects of the present disclosure, an automatically actuated lower latch assembly may also be part of the door lock system. The lower latch assembly may include a pivoting lock arm that moves between a first position and a second position, wherein in one position the latch arm securely engages a lock post and in the other position the lock arm is decoupled from the lock post. In one embodiment, the lock arm is positioned on a fixed plate located at the bottom of a first door panel and the lock post is positioned on a swing arm that pivots relative to the fixed plate. A guide post is also positioned on the swing arm and engages a track or guide channel in the bottom of a second door panel adjacent to the first panel. When the lock member engages the lock post, the swing arm is fixed in its position relative to the fixed plate and the guide post maintains the position of the second door panel a predetermined distance from the first panel. As a result, the second panel may slide relative to the first panel in the absence of a floor mounted track. When the lock member disengages or decouples from the lock post, the swing arm can pivot relative to the fixed plate. This, in turn, allows the two panels to separate from each other when moved into a fully broken open position and also accommodates a door handle affixed to the second panel, if present. It should be appreciated that the fixed plate and lock arm alternatively could be positioned opposite from that described above, i.e., in the second door panel, and the guide post and second magnet could be positioned in the first door panel.

According to aspects of the present disclosure, the lower latch assembly further includes a first magnet associated with the lock arm and a second magnet disposed in the adjacent second door panel. The first and second magnets of the lower latch assembly also have associated magnetic characteristics. When the adjacent door panels are in a fully retracted position, the first and second magnets will be positioned sufficiently near or proximate each other that the interaction of the magnetic fields of the two magnets causes the lock arm to move from the first position to the second position. Conversely, when the first and second magnets are not sufficiently proximate to each other, i.e., when one door panel slides away from the adjacent door panel, the interaction of the respective magnetic fields is lost or weakened such that the lock arm returns to its first position. The lock arm may be weighted in a manner that causes it to change positions once the strength of the interacting magnetic fields is reduced below a threshold value. Alternatively, a biasing member may be included to influence the return of the lock arm to its first position. Any type of biasing member known to those of skill in the art could be used for this purpose and is deemed within the scope of the present disclosure.

Environmental factors can influence the operation the magnets in both the upper and lower latch assemblies including the materials from which the door panels, latch assemblies and surrounding structures (e.g., door frame and carriage) are constructed (e.g., wood, metal, plastic, etc.), the location and orientation of the magnet within the door panels and the location of the magnet on the latch member (effecting the orientation of the flux pattern of the magnet), the shape of the magnet and the shape of the flux pattern of the magnet.

In one embodiment, a door package comprises an upper frame portion having one or more tracks, wherein each track is configured to slideably engage with a door panel; a door assembly comprising two or more door panels, wherein at least a first door panel slideably engages a first track and slides between a first extended position and a second retracted position; a first latch assembly disposed in an upper portion of the first door panel, the first latch assembly having a first catch member, a first latch member and a first magnet associated with the first latch member, the first magnet having a first magnetic field, wherein the first latch member is movable between a first position and a second position, the first latch member is biased to the first position, and wherein when the first latch member is in the first position the first catch member prevents movement of the first door panel away from the first track, and when the first latch member is in the second position the first catch member does not prevent the first door panel moving away from the first track; a second magnet disposed within an upper portion of the second door panel, the second magnet having a second magnetic field; wherein, when the first door panel is in the first extended position, the first and second magnetic fields do not overlap and the first latch member is in the first position, and when the first and second magnetic fields overlap, the first latch member moves to the second position and the first latch assembly does not prevent the first and second door panels from pivoting relative to the at least one or more tracks.

In a second embodiment, a door system comprises an upper frame, the frame including a sliding track configured to receive at least one sliding door panel; a first door panel having a first vertical end and a second vertical end and a top and a bottom, the first door panel pivotally interconnected to the upper frame proximate the first end; a second door panel having a first vertical end and a second vertical end, the second door panel slideably engaged with the sliding track and interconnected to the first door panel, the second door panel movable between a first position substantially alongside the first door panel and a second position extending beyond the first door panel, the second door panel having a top portion and a body portion and wherein the body portion is pivotally interconnected to the top portion proximate the first vertical end of the second panel; a first latch assembly comprising a catch, a latch tongue, a first magnet associated with the latch tongue and a second magnet, the latch tongue biased to a first position wherein the latch tongue engages the catch and a second position wherein the latch tongue does not engage the catch, the catch disposed in one of the top portion or the body portion of the second door panel, the latch tongue disposed in other of the top portion and body portion of the second door; and a second magnet disposed in the first door panel proximate the second end of the first door panel; wherein when the second door panel is substantially alongside the first door panel, the magnetic field of the second magnet interacts with the magnetic field of the first magnet to move the latch tongue to the second position, and when the second door panel is not substantially alongside the first door panel, the magnetic fields of the first and second magnets do not interact to cause the latch tongue to move out of the first position.

In a third embodiment, a door package comprises a door frame having a top portion, a first jamb connected to a first end of the top portion, and a second jamb connected to a second end of the top portion, the top portion including one or more tracks operable to slideably engage with at least one door panel of a door assembly; a door assembly comprising two or more door panels, wherein at least a first door panel of the two or more door panels is slideably engaged with the top portion of the door frame, and wherein a second door panel has a first vertical edge and a second vertical edge, and the first vertical edge is positioned proximate the first doorjamb; a pivot plate configured to connect to a floor at a position proximate the first door jamb and to pivotally engage with the two or more door panels and to allow the door assembly to pivot away from the plane of the door frame when the two or more door panels are in the open position; a first latch assembly associated with the first door panel, the first latch assembly having a first catch member and a first latch member, wherein the first latch member is movable between a first position and a second position, and when the first latch member is in the first position the first catch member prevents pivoting movement of the first door panel, and when the first latch member is in the second position the first catch member does not prevent pivoting movement of the first door panel; an actuator comprising a first member associated with the first latch member and a second member associated with the second door panel, wherein when the door assembly is in the open position, the location of the second member relative to the first member causes the first latch member to move to the second position and the door assembly is operable to pivot to a broken open position that is substantially perpendicular to the plane of the door frame, thereby providing an entrance opening having substantially the same width as the distance between the first and second jambs of the door frame.

The foregoing descriptions of the latch arm of the upper latch assembly and the lock arm of the lower latch assembly disclose arms that move in a pivoting or toggling motion about a pivot pin to engage a post, catch or other member complementary to the shape of the latch arm or lock arm. Those of ordinary skill in the art will appreciate upon review of the present disclosure that one alternative would be a slide window shutter style latch. In addition, other types of movement could be substituted for the pivoting motion and are deemed to be within the scope of the present disclosure. For example, rather than pivoting, the latch arm and/or the lock arm could move linearly between a first position and a second position such as a pin and hole latch. The pin may be actuated under the influence of one or more magnets, a cam or other mechanical actuator, or may be electronically controlled such as by a motor or electromagnetic device. In addition, the foregoing descriptions describe upper and lower latch assemblies in which the magnetic fields of two magnets interact. It should be appreciated that more than two magnets may be utilized as an actuator. For example, multiple magnets may be associated with the latch arm and/or lock arm and a single magnet is associated with the adjacent door panel, a single magnet may be associated with the latch arm and/or lock arm and multiple magnets may be associated with the adjacent door panel, or multiple magnets may be associated with the latch arm and/or lock arm and the adjacent door panel. Alternatively, the latch arm and/or lock arm may be constructed of ferrous material and one or more magnets positioned in the adjacent door panel such that when the magnet is sufficiently proximate or close to the latch arm and/or lock arm, the latch arm and/or lock arm is caused to move or be actuated due to the interaction of the magnet (or multiple magnets) on the ferrous material. Further still, the latch arm and/or lock arm may have one or more associated magnets that are attracted to a ferrous component in an adjacent door panel, causing the desired actuation or movement. These alternatives, as well as those that occur to persons of ordinary skill in the art upon review of this disclosure, are deemed to be within the scope of the present disclosure.

The Summary of the Invention is neither intended nor should it be construed as being representative of the full extent and scope of the present invention. Moreover, reference made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, explain the principles of these inventions.

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Figure 1:
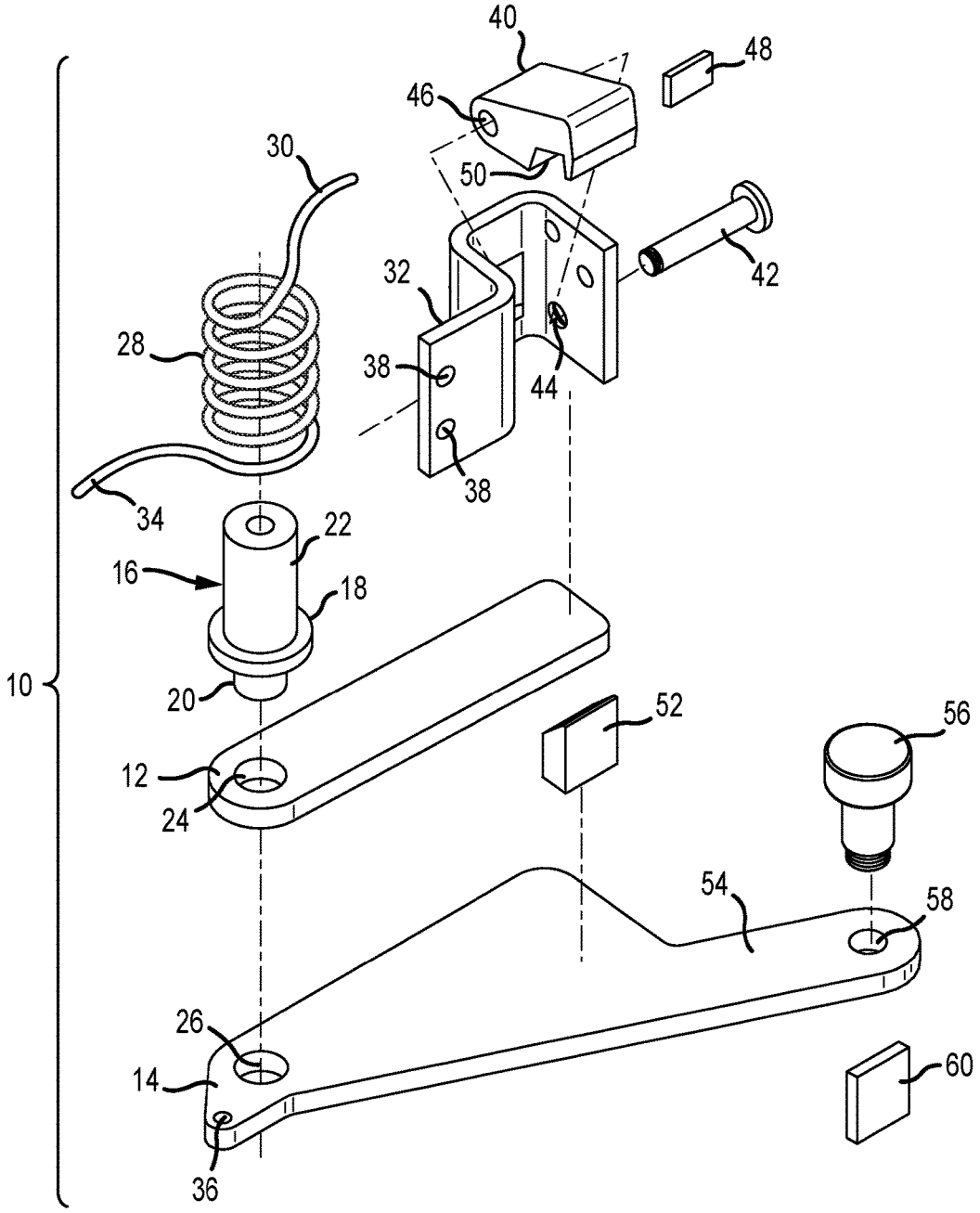
FIG. 1 is an exploded perspective view of an embodiment of a lower latch assembly.

FIG. 1 is an exploded view of one embodiment of a lower latch assembly 10. As shown, the lower latch assembly 10 includes a fixed plate 12 and a swing arm 14 configured to pivot relative to the fixed plate 12 about the lower portion of a support post 16. The support post 16 has an outwardly extending flange 18 that separates the lower portion 20 from the upper portion 22. The lower portion 20 extends through an aperture 24 in the fixed plate and into an aperture 26 in the swing arm 14. The flange 18 abuts the fixed plate 12 and stabilizes the support post 16 within the apertures. A biasing spring 28 is positioned around the upper portion 22 of the support post 16 with one end 30 interconnected to a door mount 32 and the opposite end 34 interconnected to the swing arm 14 at aperture 36. The biasing spring 28 assists in maintaining alignment of the fixed plate 12 and swing arm 14 such that the swing arm 14 may pivot relative to the fixed plate 12 without binding. The fixed plate 12 is positioned along the bottom edge of a door panel with the support post 16 and the door mount 32 positioned interior of the door panel. Screw holes 38 are formed in the door mount 32 to interconnect the fixed plate 12 to the door panel. A lock arm 40 is pivotally connected to the door mount 32 by pivot pin 42 which extends through apertures 44 formed in the door mount 32 and bore 46 formed in the lock arm 40. A magnet 48 is disposed on an outer surface of the lock arm 40. The magnet 48 may be positioned on any surface of the lock arm 40, multiple magnets may be positioned on more than one surface of the lock arm 40, the magnet may be positioned inside of the lock arm 40, or the lock arm 40 may be magnetic itself. A cutout, recess or groove 50 is formed in the lock arm 40 and is configured to engage a lock post 52 mounted to and extending upwardly from the swing arm 14. The swing arm 14 includes a finger portion 54 that extends laterally away from the fixed plate 12. A guide post 56 is connected to the finger portion 54 of the swing arm 14 at aperture 58. The guide post 56 is configured to slide within an internal door track (510) disposed within the bottom of an adjacent door panel as more fully described in U.S. Pat. No. 8,096,342.

A second magnet 60, located in the same adjacent door panel, interacts with the magnet 48 associated with the lock arm 40 to actuate or move the lock arm 40 between a first position and a second position depending upon the proximity of the second magnet 60 relative to the lock arm magnet 48. More specifically, magnetic flux patterns associated with the magnets 48 and 60 interact when the magnets 48 and 60 are proximate each other to cause the lock arm 40 to move from the first position and the second position. In the first position, the upper portion of the lock post 54 is captured by the channel 50 of the lock arm 40. In the second position, the lock arm 40 has pivoted upwardly such that the channel 50 has disengaged the lock post 52. A biasing member (not shown) may optionally be included to bias the lock arm 40 into its first position where it engages the lock post 52. Alternatively, the lock arm 40 may be weighted in such a way as to bias it into the first position. The purpose of the lock arm 40 and lock post 52 is to prevent lateral movement of the swing arm 14 away from the fixed plate 12. Those of ordinary skill in the art, upon review of the present disclosure, will recognize that the interconnection between the fixed plate 12 and swing arm 14 may be accomplished in many other ways, all of which are deemed within the scope of the present disclosure. It will also be appreciated by those of ordinary skill in the art, upon review of the present disclosure, that the second magnet 60 may be positioned at different locations within the adjacent door panel depending upon the strength of the magnetic fields and flux patterns of the magnets 48 and 60, and also considering possible interference from the structure of the door panels and any surrounding structure.

It should also be appreciated that the second magnet 60 may comprise multiple magnets rather than a single magnet. Further still, it should be appreciated that actuation of the lower latch assembly does not require the first magnet 48 and the second magnet 60. In one alternative embodiment, one of the first magnet 48 and second magnet 60 may be replaced by a member made of ferrous material. For example, the lock arm 40 could be a first member made of a ferrous material and the magnet 60 can be a second member. Together, the first and second members comprise an embodiment of an actuator. When the magnet 60 is proximate the lock arm 40, the interaction between the magnet 60 and the ferrous lock arm 40 will cause the lock arm 40 to move from the first position to the second position. As a further alternative, a ferrous member could be substituted for the first magnet 48 and mounted on the lock arm 40. In yet a further alternative, one or more ferrous members could substitute for the second magnet 60 and a first magnet 48 remains associated with the lock arm 40.

Figure 2A:
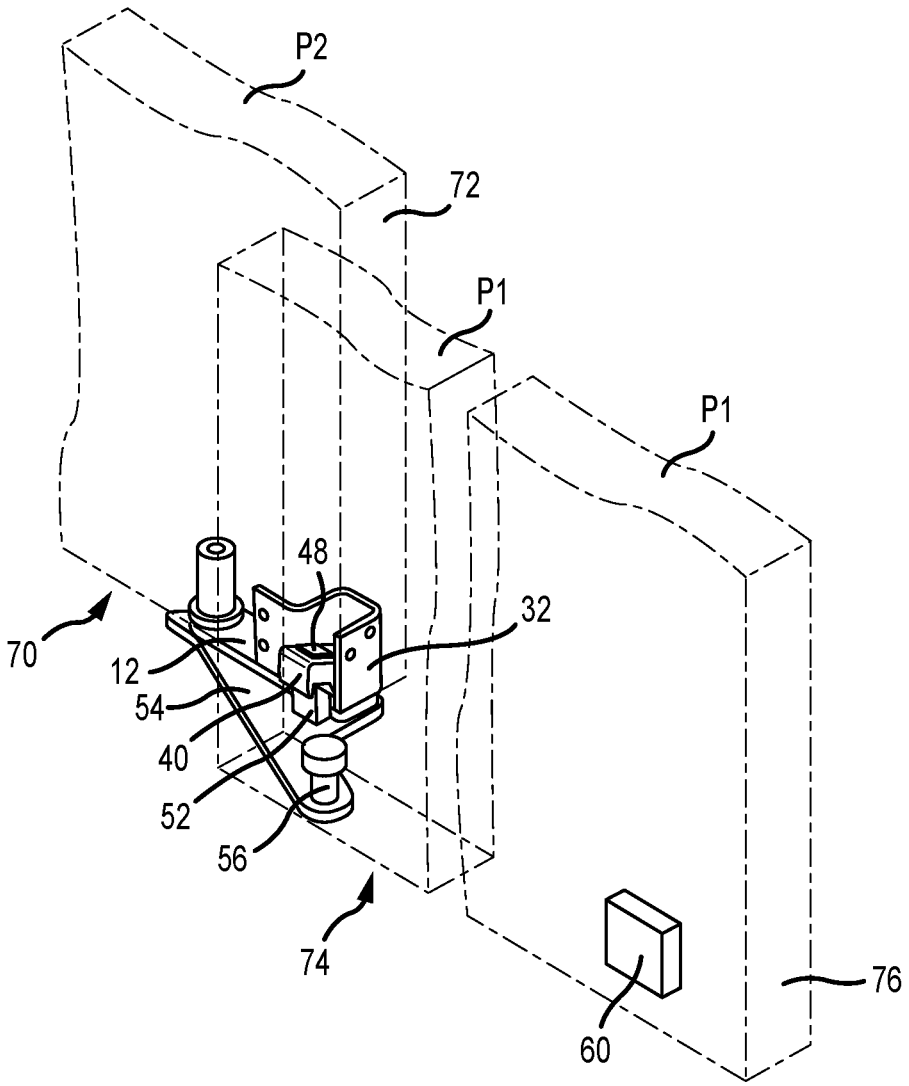
FIG. 2A is a perspective view of the lower latch assembly of FIG. 1, positioned in a door package with the door panels in an extended position.

FIG. 2A shows the lower latch assembly 10 mounted in association with two adjacent door panels P1 and P2. More specifically, an opening is formed along the lower edge 70 of door panel P2 proximate the leading edge 72. The door mount 32 is affixed to the door panel P2 such that the fixed plate 12 and support post 16 are mounted in the interior of the door panel P2 and the lock arm 40 is positioned partially within the door panel P2 and extends partially out from the door panel P2. The finger portion 54 of the swing arm 14 extends laterally away from the fixed plate 12 such that the guide post 56 is oriented in the lower portion 74 of door panel P1. A track or groove (not illustrated for clarity purposes) is formed along the interior lower edge 74 of door panel P2, and door panel P1 slides relative to door panel P2 and maintains its position relative to door panel P2 by guide post 56. Actuation magnet 60 is disposed in the lower portion 74 of door panel P1 along the leading edge 76. As shown, the lock arm 40 engages or captures the lock post 52 within the cutout 50 of the lock post 52 to prevent the swing arm 14 from pivoting relative to the fixed plate 12.

Figure 2B:
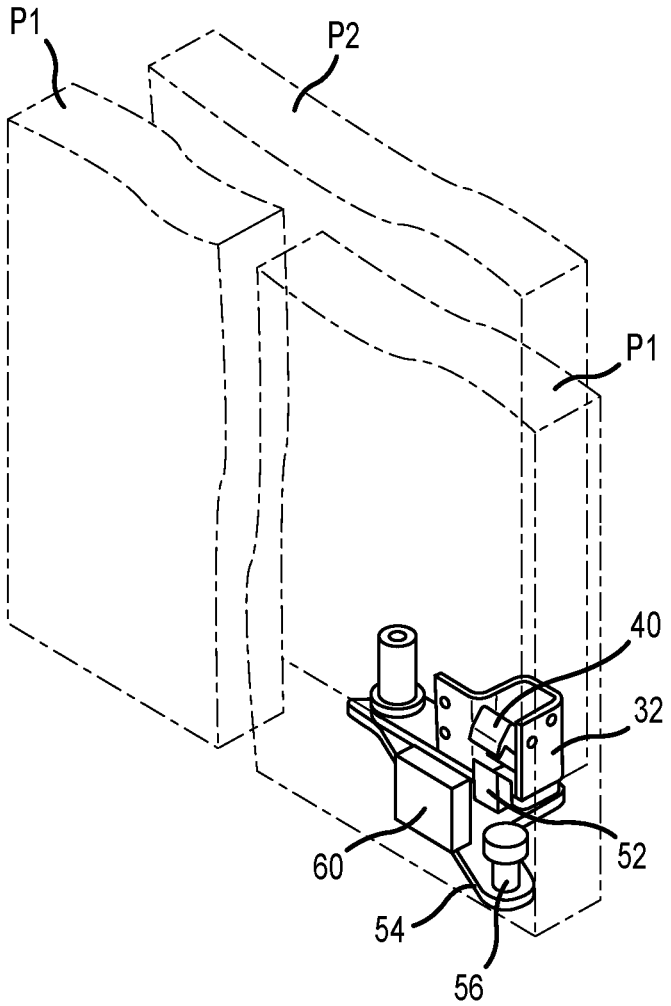
FIG. 2B is a perspective view of the lower latch assembly of FIG. 1, positioned in a door package with the door panels in a retracted position.

In contrast, FIG. 2B shows the door panel P1 oriented in a retracted position adjacent to and overlapping door panel P2. In this orientation, activation magnet 60 is proximate lock arm magnet 48, and the interaction of the flux patterns of the two magnets causes the lock arm 40 to move from a first position (as shown in FIG. 2A where the cutout 50 engages the lock post 52) to a second position where the lock arm 40 disengages and separates from the lock post 52. In the second position, shown in FIG. 2B, the swing arm 14 can pivot relative to the fixed plate 12 and the door panel P1 can separate from door panel P2.

It should be appreciated that the door panels as shown in the present disclosure may be of most any size in width, height and thickness. This is represented, for example, in FIGS. 2A and 2B by illustrated panel P1 as split into two pieces.

Figure 3A:
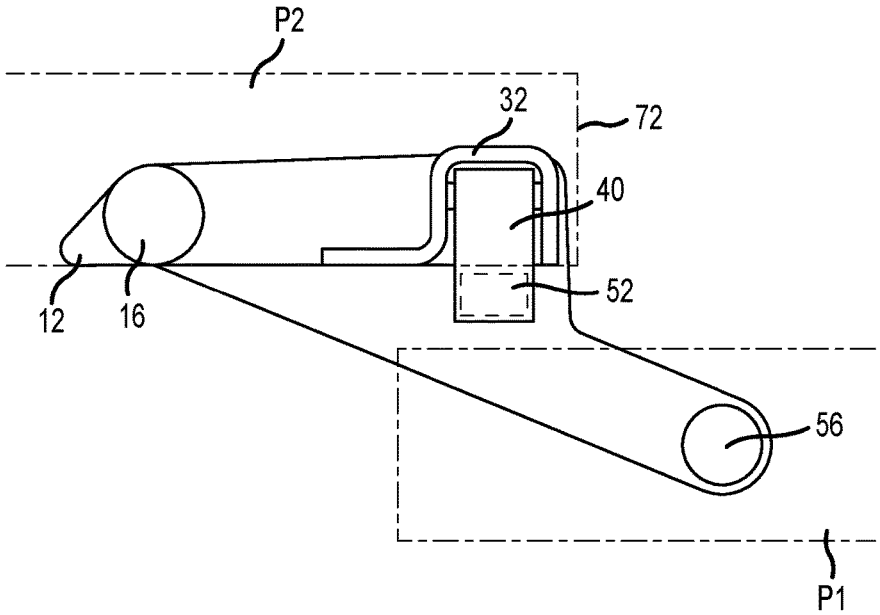
FIG. 3A is a top plan view of a portion of the lower latch assembly as shown in FIG. 2A.
Figure 3B:
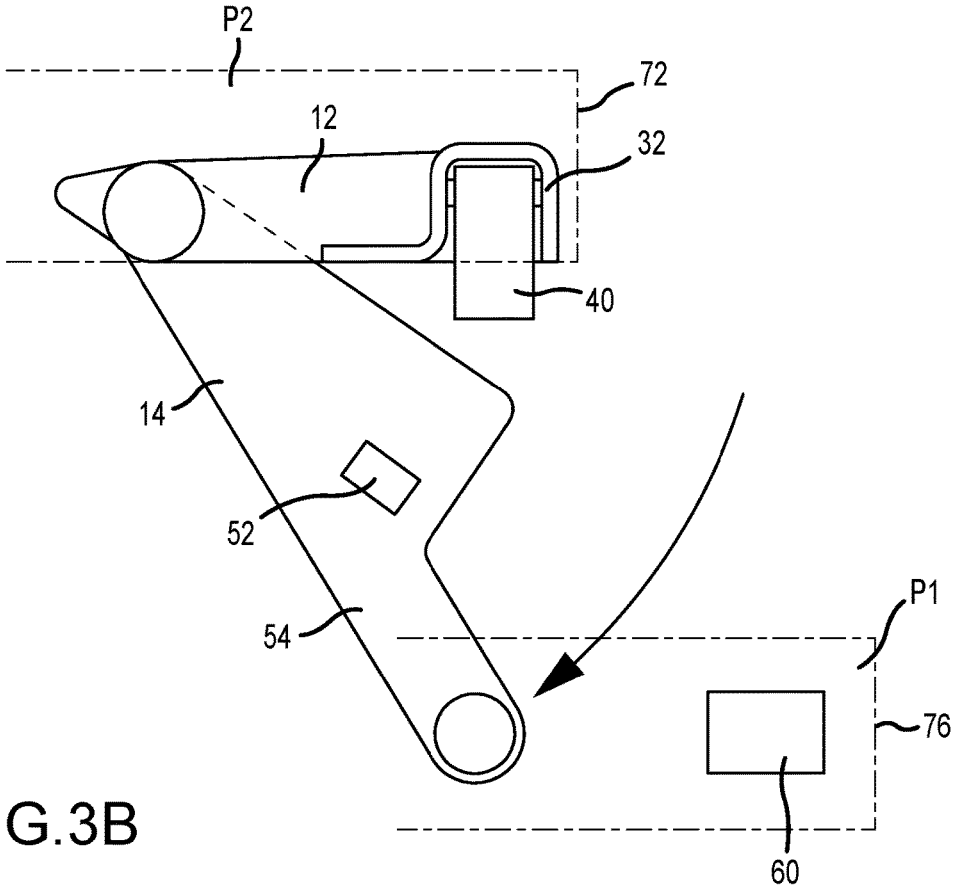
FIG. 3B is a top plan view of the lower latch assembly as shown in FIG. 2B, further showing the door panels slightly separated.

FIGS. 3A and 3B are top views of the embodiments shown in FIGS. 2A and 2B, respectively. As shown in FIG. 3A, door panel P1 is in an extended position relative to door panel P2 and the lock arm 40 is engaged with the lock post 52. Because of this locking arrangement, the swing arm 14 is secured in the position shown such that the guide post 56 remains in a fixed position and functions to provide a lower guide for the sliding motion of door panel P1, thereby eliminating a need for a floor track. In FIG. 3B the actuation magnet 60 is located proximate the lock arm magnet 48. In this orientation, the lock arm 40 moves to its second location and disengages from the lock post 40, allowing the swing arm 14 to pivot relative to the fixed plate 12 and thereby allows the door panel P1 to move away from door panel P2.

Figure 4:
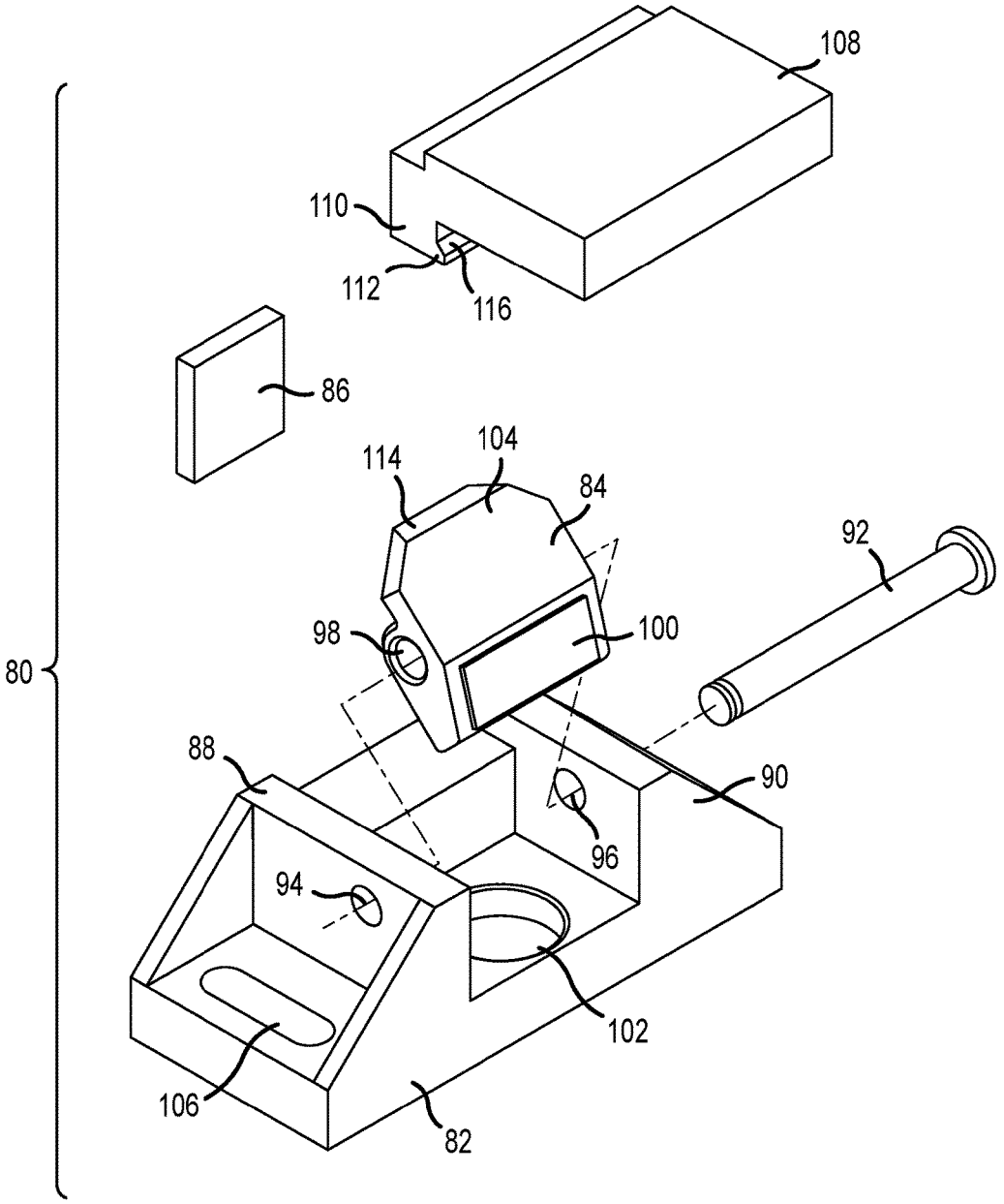
FIG. 4 is an exploded perspective view of an embodiment of an upper latch assembly.

FIG. 4 is an exploded view of an upper latch assembly 80, comprising a base 82, a latch arm 84, and a first magnet 86. More specifically, the base 82 includes two opposed end walls 88 and 90 that extend upwardly to form a space in which the latch arm 84 is positioned. A pivot pin 92 extends through apertures 94 and 96 in the end walls 88 and 90, and through a pin receiving bore 98 in the latch arm 84, such that the latch arm 84 moves between a first position and a second position relative to the base 82. A latch arm magnet or second magnet 100 is positioned on a face of the latch arm 84. The magnet 100 may be positioned on any surface of the latch arm 84, positioned inside the latch arm 84, or the latch arm 84 may be magnetic itself. A spring well 102 is formed in the base 82 to secure a coil spring (not shown) or other bias member to bias the latch arm 84 into its first position where the tongue or nose 104 of the latch arm 84 is extended away from the base 82. Alternatively, the latch arm 84 may be weighted in such a way as to bias the latch arm 84 into the first position. Mounting apertures 106 are formed in the base 82 for attaching the base 82 to a door panel. A catch member 108 is also shown and includes a downwardly depending leg 110 with an outwardly extending lip 112 configured to engage the tongue 104 of the latch member 84. The leading edge 114 of the tongue 104 may be beveled or shaped in a way that complements or conforms to the shape of the groove 116 formed by the leg 110 and lip 112. The groove 116 extends along the length of the lower side of catch member 108.

Figure 5A:
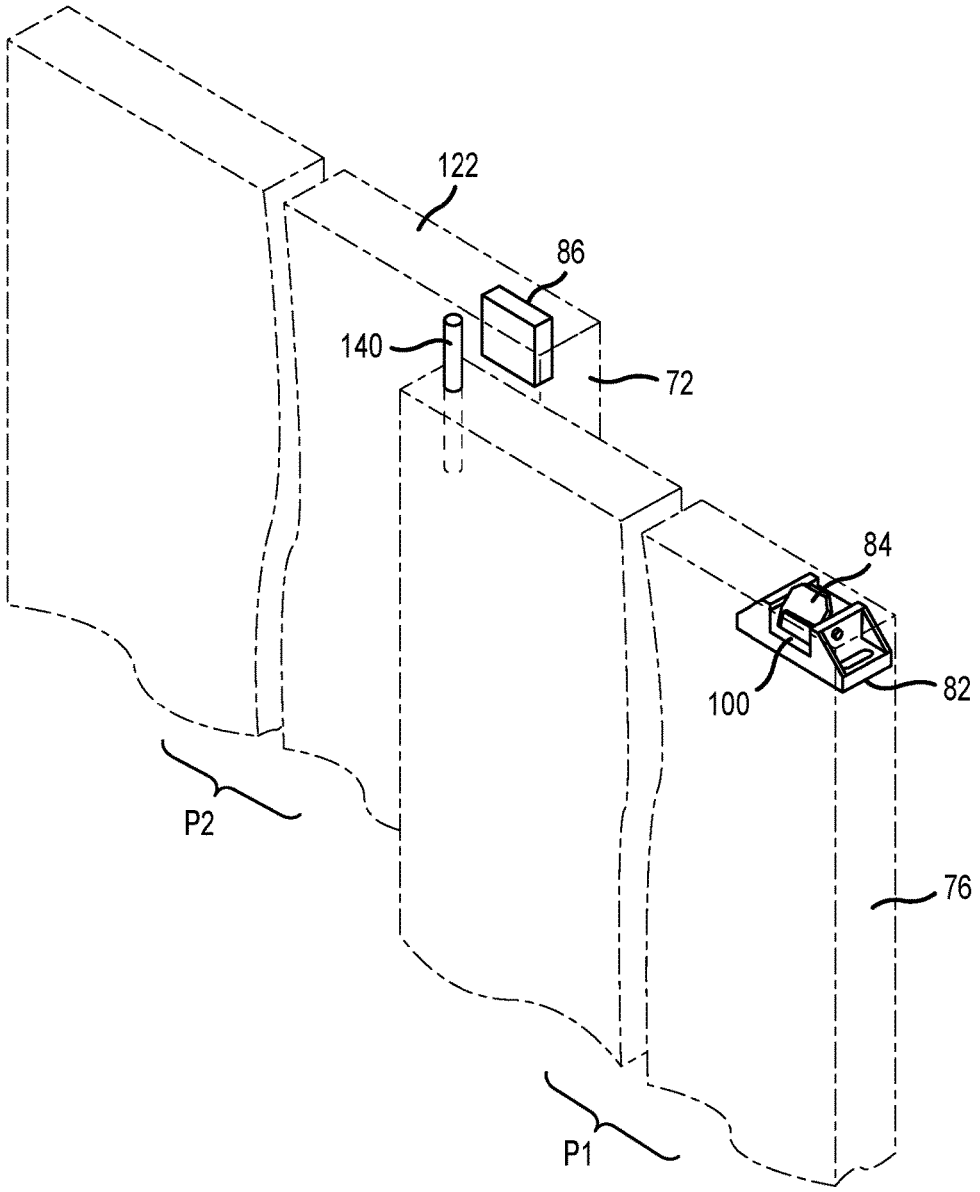
FIG. 5A is a perspective view of the upper latch assembly of FIG. 4, positioned in a door package with the door panels in an extended position.

FIG. 5A shows door panels P1 and P2 in an extended orientation. As illustrated, the base 82 is positioned along the upper edge 120 of door panel P1 proximate the leading end 76. Actuation magnet 86 is positioned along the upper edge 122 of door panel P2 proximate the leading edge 72. In this orientation, the flux patterns of latch arm magnet 100 and actuation magnet 86 do not interact and the latch arm 84 is oriented in its first position extending upwardly from the base 82.

Figure 5B:
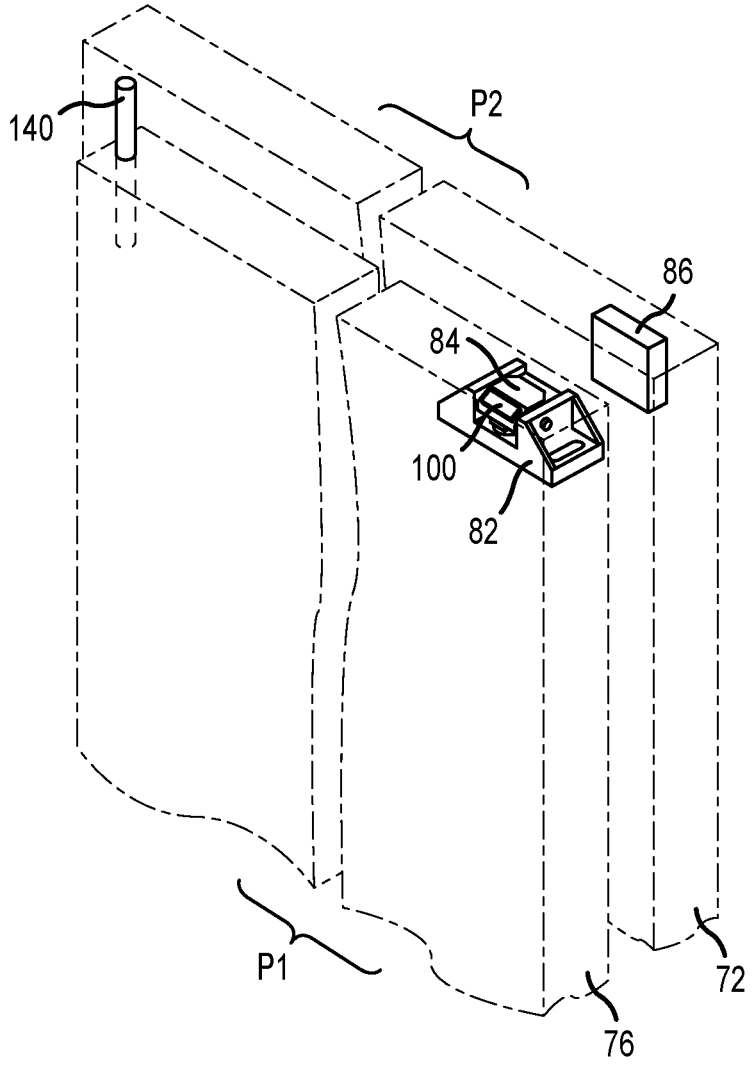
FIG. 5B is a perspective view of the upper latch assembly of FIG. 4, positioned in a door package with the door panels in a retracted position.

In FIG. 5B, the door panels P1 and P2 are shown in a retracted orientation. In this orientation, the actuation magnet 86 positioned along the top edge 122 of the door panel P2 is proximate the latch arm magnet 100 positioned along the top edge 120 of door panel P1 such that the interacting flux patterns of the two magnets cause the latch arm 84 to move to its retracted or second position.

Figure 6:
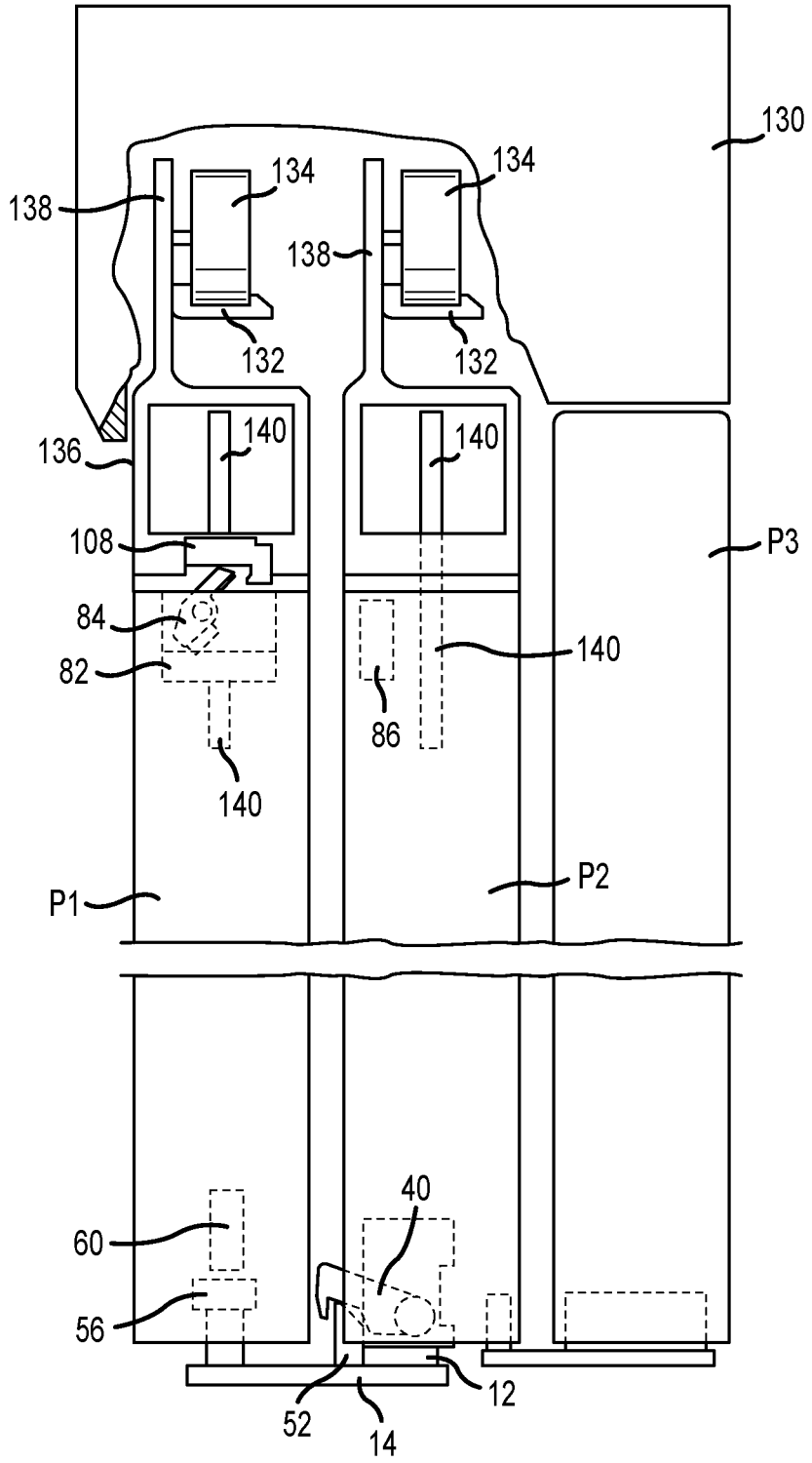
FIG. 6 is an end view of a door package having three door panels, with the panels in an extended position, and further showing a lower and upper latch assembly according to embodiments of the present disclosure.

FIG. 6 is an end view of a three-panel door package, although the principles described herein apply equally to a two-door package or any other type of package. FIG. 6 corresponds to FIGS. 2A and 3A, where the door panels P1 and P2 are in an extended or non-retracted position. The door package shown includes an upper frame 130 that is installed along the upper horizontal surface of a doorway opening. Panel P3 is illustrated as a non-sliding panel, but can be sliding panel. Here, door panels P1 and P2 are oriented adjacent to door panel P3 and slide along tracks 132 on rollers 134. A trolley or carriage 136, including support structure 138, interconnects the rollers 134 to the door panels P1 and P2. The carriage 136 extends along the top of the panels P1 and P2. The catch member 108, previously described in connection with FIG. 4, is connected to the carriage 136 of door panel P1 at a location that permits the catch member 108 to interface with the latch arm 84. As shown, the interface is along the horizontal interface between the top edge 120 of panel P1 and the bottom of the carriage 136. The interface could be along a vertical edge of the panel P1 and carriage 136 or any other location as would be recognized by a person of skill in the art upon review of the present disclosure. The groove 116 formed by the leg 110 and the lip 112 of the catch member 108 creates a catch that interacts with the nose 114 of the latch arm 84. When the latch arm 84 is in its first position it engages the catch member 108 and prevents the panel P1 from moving laterally (as depicted in FIG. 6), although the panel P1 may still slide along the track 132 (in and out of the plane of FIG. 6). Optionally, panel P2 may also include an upper latch assembly 80 (not shown).

Figure 7:
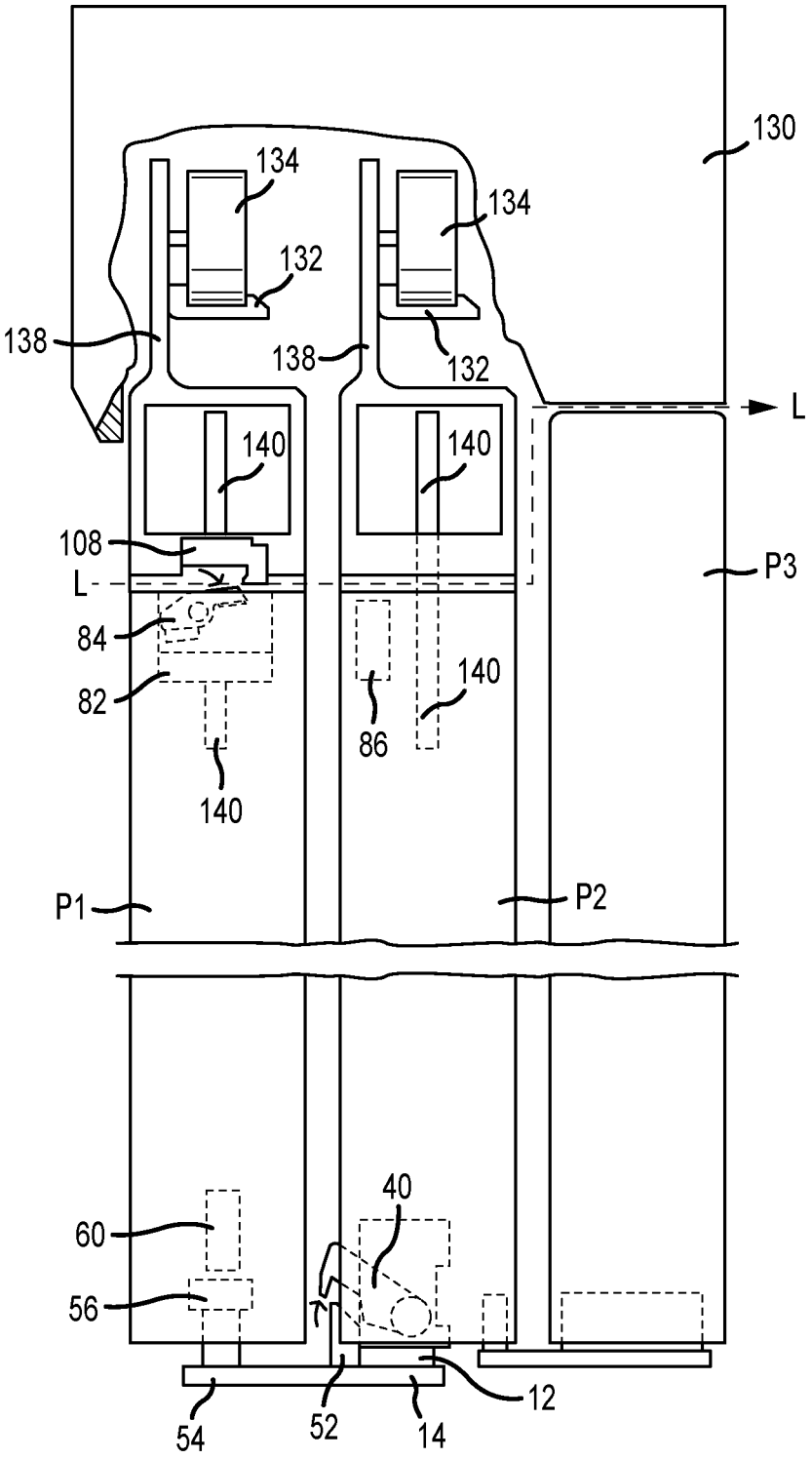
FIG. 7 is an end view of a door package having three door panels, with the panels in a retracted position, and further showing a lower and upper latch assembly according to embodiments of the present disclosure.

FIG. 7 is an end view of the door package with the door panels P1, P2 and P3 in a retracted or open position corresponding to the two-panel package of FIGS. 2B and 3B. Here, the actuation magnet 86 of the upper latch assembly 80 is sufficiently proximate the magnet 100 that the flux patterns of the two magnets interact to move the latch arm 84 into a retracted position disengaged from the catch 108.

It should also be appreciated that the second magnet 86 may comprise multiple magnets rather than a single magnet. Further still, it should be appreciated that actuation of the upper latch assembly does not require the first magnet 100 and the second magnet 86. In one alternative embodiment, one of the first magnet 100 and second magnet 86 may be replaced by a member made of ferrous material. For example, the latch arm 84 could be a first member made of a ferrous material and the magnet 86 can be a second member. Together, the first and second members comprise one embodiment of an actuator. When the magnet 86 is proximate the latch arm 84, the interaction between the magnet 86 and the ferrous latch arm 84 will cause the latch arm 84 to move from the first position to the second position. As a further alternative, a ferrous member could be substituted for the first magnet 100 and mounted on the latch arm 84. In yet a further alternative, one or more ferrous members could substitute for the second magnet 86 and a first magnet 100 remains associated with the latch arm 84.

Panels P1 and P2 also include a pivot post 140 that extends between and interconnects the panel P1 to its carriage 136 and panel P2 to its carriage 136. The pivot post 140 is located proximate the trailing edge of the panels P1 and P2, for example as shown in FIGS. 5A and 5B with respect to panel P1 (a single slide package). When the latch arm 84 moves to its disengaged or retracted position, the panels P1 and P2 are partially disconnected from the carriages 136. The connection formed by the pivot post 140 remains but allows the panels P1 and P2 to pivot relative to the carriages 136 about the pivot posts 140.

A lower latch assembly 10 is also illustrated in FIGS. 6 and 7. In FIG. 6, with the panels is an extended position, the lock arm 40 secures the lock post 52. In FIG. 7, with the panels in a retracted position, the lock arm 40 is separated from the lock post 52. Thus, the operation of the lower latch assembly 10 and upper latch assembly 80 prevent the panels from moving laterally (out of the plane defined by the sliding tracks 132) while allowing the panels to slide along the tracks 132. When the panels are in the retracted position illustrated in FIG. 7, the automatic interaction of magnets 48 and 60 of the lower latch assembly 10 and the interaction of the magnets 86 and 100 of the upper latch assembly 80 cause the lock arm 40 to disengage or separate from the lock post 52 and the latch arm 84 to disengage or separate from the catch member 108. Conversely, when the magnets 48 and 60 of the lower latch assembly are separated by a sufficient distance, depending upon the strength of the magnetic fields and flux patterns and orientation of the magnets, the lock arm automatically returns to the first position and engages or captures the lock post 52 and the latch arm 84 returns to its first position where it is configured to engage the groove 110 of the catch member 108 to prevent lateral movement of the panels P1, P2 and P3. A door guide pin assembly (reference number 208 in U.S. Pat. No. 8,096,342) is shown interconnecting the lower portions of panels P3 and P2. Optionally, a lower latch assembly 10 may also be substituted for the door guide pin assembly.

Figure 8:
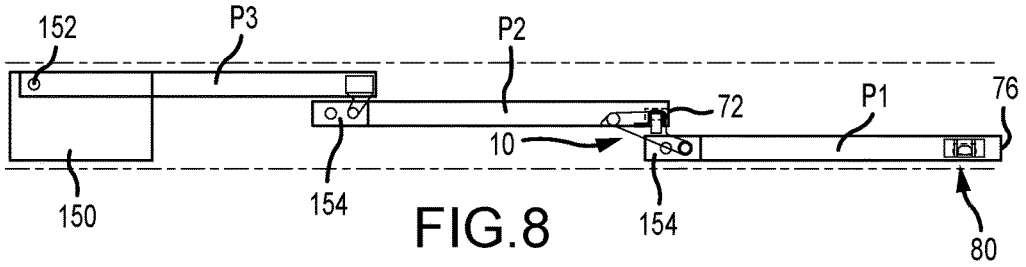
FIG. 8 is a top plan view of the door package of FIG. 7.

Turning to FIGS. 8-11, operation of a three-panel telescoping door package is explained. In FIG. 8, the three panels P1, P2 and P3 comprising the door package are in a fully extended or telescoping orientation. Panels P1 and P2 are interconnected to an overhead track 132 (not shown) and slide left and right between an open and closed position. In this embodiment, panel P3 does not slide. A pivot plate 150 is mounted to the floor on the far left at a position typically proximate the left door jamb of the doorway opening. Panel P3 pivots about a pivot pin 152 associated with the pivot plate 150. An upper latch assembly 80 is positioned proximate the leading edge 76 of panel P1. A lower latch assembly 10 is positioned proximate the leading edge 72 of panel P2 with the guide post 56 positioned in a groove or channel formed in the lower edge 74 of panel P1. A door guide pin assembly, described in U.S. Pat. No. 8,096,342 (reference number 208) interconnects the bottoms of Panels P2 and P3. It should be appreciated that a lower latch assembly 10 could substitute for the door guide pin assembly, and also that an upper latch assembly 80 could be added to the upper portion of Panel P2.

Figure 9:
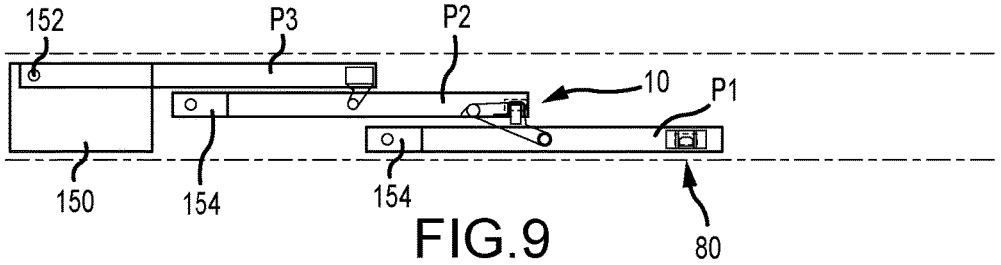
FIG. 9 is a top plan view of the door package of FIG. 6, with the door panels partially retracted.

In FIG. 9, the panels P1, P2 and P3 are partially open. However, the actuation magnet 60 of the lower latch assembly 10 and the actuation magnet 86 of the upper latch assembly 80 are not sufficiently near or close to the magnets 48 and 100, respectively to cause the lock arm 40 and latch arm 84 to move from the first position to the second position. Because lower latch assembly 10 and the upper latch assembly 80 are in locked or secured states, panels P1 and P2 may slide relative to the door frame 130 but are otherwise restricted in motion.

Figure 10:
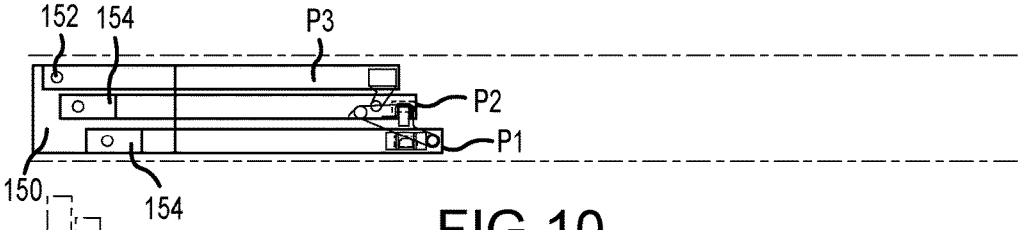
FIG. 10 is a top plan view of the door package of FIG. 7.
Figure 11:
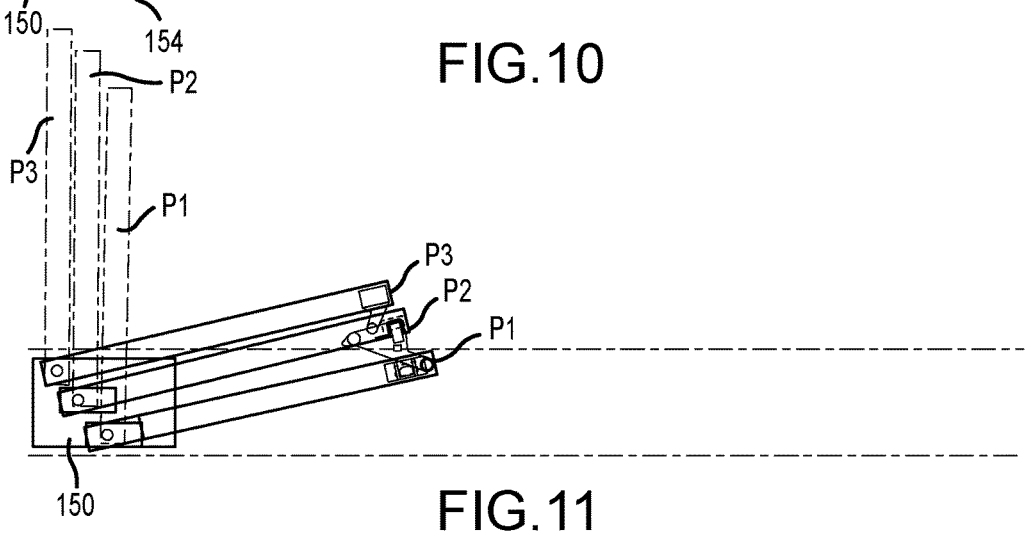
FIG. 11 is a top plan view of the door package of FIG. 7 showing the door panels partially broken out and fully broken out.

In FIG. 10, the panels P1, P2 and P3 are in a fully retracted position corresponding to that shown in FIG. 7. Door panels P1 and P2 include a pivot block 154 at the lower and trailing edges of the panel that engage with the pivot plate 150 when the panels P1 and P2 are in the fully retracted position. The pivot blocks permit the panels P1 and P2 to pivot relative to the pivot plate 150. As previously described, the pivot posts 140 permit the panels P1 and P2 to pivot relative to the carriages 136. In the retracted orientation, the lock arm 40 of the lower latch assembly 10 and the latch arm 84 of the upper latch assembly 80 have automatically moved to an unlocked or disengaged state due to the proximity of magnets 48 and 60 and magnets 82 and 100, respectively. With the lower latch assembly 10 and upper latch assembly 80 in a disconnected state, the three panels P1-P3 can pivot as shown in FIG. 11 and move to a position substantially perpendicular to the opening of the doorway. As shown in FIG. 7, the door panels P1-P3 separate from the upper track assembly 130 along line L. The disengagement of the swing arm 14 from the fixed plate 12 allows the door panels P1 and P2 to separate while they pivot to accommodate a door handle associated with panel P1.

Figure 12:
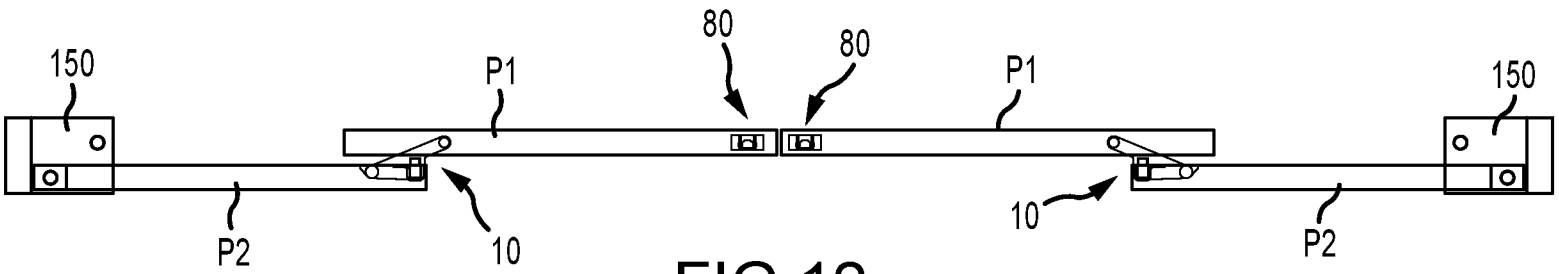
FIG. 12 is a top plan view of a door package with two two-panel doors in accordance with one embodiment of the present disclosure.
Figure 13:
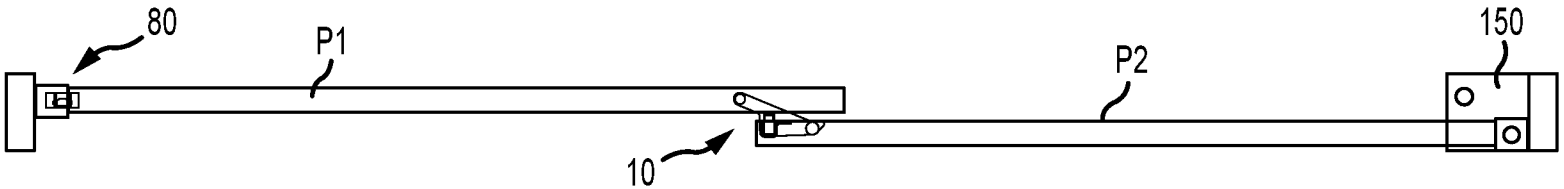
FIG. 13 is a top plan view of a door package with a two door panels in accordance with one embodiment of the present disclosure.
Figure 14:
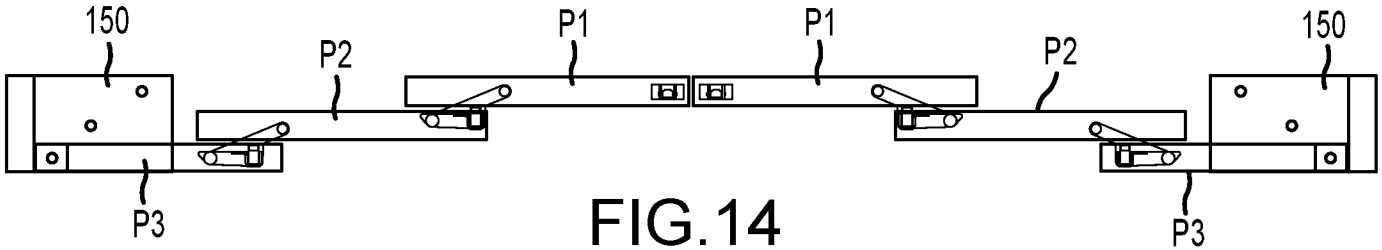
FIG. 14 is a top plan view of a bi-parting door package with two telescopic three-panel doors in accordance with one embodiment of the present disclosure.
Figure 15:
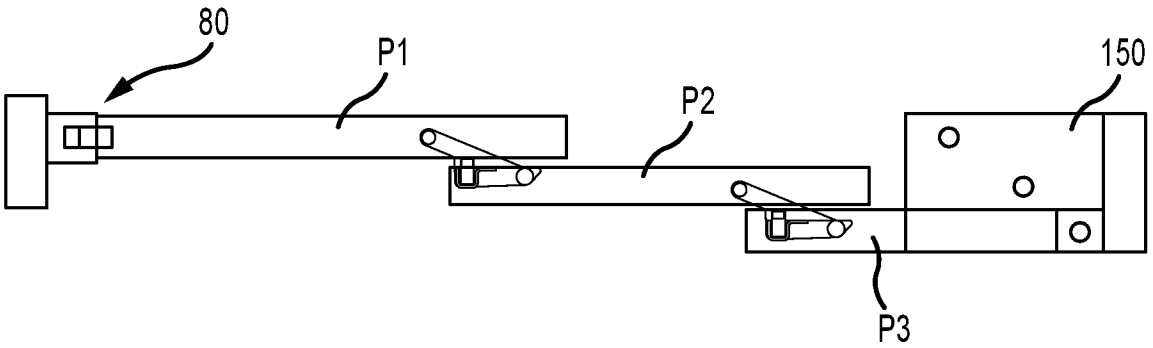
FIG. 15 is a top plan view of a single slide door package with two telescopic door panels in accordance with one embodiment of the present disclosure.

While various embodiments of the present invention have been described in detail, it is apparent that modifications and alterations of those embodiments will occur to those skilled in the art. It is to be expressly understood that such modifications and alterations are within the scope and spirit of the present invention, as set forth in the following claims. For example, the lower and upper latch assemblies 10 and 80 may be used with different door packages, including a two-panel bi-part door package as shown in FIG. 12, a two-panel sliding door package as shown in FIG. 13, and a telescoping bi-part door package as shown in FIG. 14. In addition, the automatic actuation of the lock systems need not be magnetically actuated. For example, optical sensor may be positioned in association with the door panels to sense when the door panels are and are not in a fully retracted position. Acting through a controller or processor, a signal from the sensors can trigger the actuation of an electromechanical lock system moving lock members between coupled and decoupled positions. These devices could be battery powered with replaceable or rechargeable batteries or could be directly powered from an existing power source using batteries of other backup power supplies as may be needed in the event of a power loss.

Other modifications or uses for the present invention will also occur to those of skill in the art after reading the present disclosure. Such modifications or uses are deemed to be within the scope of the present invention.

What is claimed is:

1. A door system comprising:

a. an upper frame, the frame including a first sliding track configured to receive at least one sliding door panel;

b. a first door panel having a first vertical end and a second vertical end and a top and a bottom, the first door panel pivotally interconnected to the upper frame proximate the first vertical end of the first door panel;

c. a second door panel having a first vertical end and a second vertical end, the second door panel slideably engaged with the first sliding track and interconnected to the first door panel, the second door panel movable between a first position substantially alongside the first door panel and a second position extending beyond the first door panel, the second door panel having a top portion and a body portion and wherein the body portion is pivotally interconnected to the top portion proximate the first vertical end of the second panel;

d. a first latch assembly comprising a first catch, a first latch tongue, a first magnet associated with the first latch tongue and a second magnet, the first latch tongue biased to a first position wherein the first latch tongue engages the first catch and movable to a second position wherein the first latch tongue does not engage the first catch, the first catch disposed in one of the top portion or the body portion of the second door panel, the first latch tongue disposed in the other of the top portion or the body portion of the second door panel, the second magnet disposed in the first door panel, and wherein the first magnet has a first magnetic field and the second magnet has a second magnetic field;

e. wherein when the second door panel is substantially alongside the first door panel, the second magnet is positioned proximate the first magnet and the magnetic field of the second magnet interacts with the magnetic field of the first magnet to move the first latch tongue to the second position, and when the second door panel is not substantially alongside the first door panel, the first magnetic field of the first magnet does not interact with the second magnetic field of the second magnet and the first latch tongue is in the first position.

2. The door system of claim 1, further comprising a third door panel having a first vertical end and a second vertical end and a top and a bottom and a second sliding track parallel to the first sliding track, the third door panel pivotally interconnected to the upper frame proximate the first vertical end of the third door panel and the first door panel slideably interconnected to the third door panel, wherein the third door panel does not slide relative to the upper frame, the first door panel slideably engaged with the second sliding track and movable between a first position wherein the first door panel is substantially alongside the third door panel and a second position wherein the first door panel extends beyond the third door panel, and the first, second and third door panels pivot about a pivot plate disposed proximate the first vertical end of the third door panel when the first door panel and second door panel are positioned substantially alongside the third door panel.

3. The door system of claim 1, further comprising a first biasing member for biasing the first latch tongue in the first position.

4. The door system of claim 1, further comprising a pivot plate engageable with a floor and with the first door panel and the second door panel, and wherein the first door panel and the second door panel pivot about the pivot plate.

5. The door package of claim 1, further comprising:

a. a second sliding track associated with the upper frame;

b. a third door panel having a first vertical end and a second vertical end, the third door panel slideably engaged with the second sliding track, the third door panel movable between a first position substantially alongside the second door panel and a second position extending beyond the second door panel, the third door panel having a top portion and a body portion and wherein the body portion of the third door panel is pivotally interconnected to the top portion of the third door panel proximate the first vertical end of the third door panel;

c. a second latch assembly comprising a second catch, a second latch tongue, a third magnet associated with the second latch tongue and a fourth magnet, the second latch tongue biased to a first position wherein the second latch tongue engages the second catch and movable to a second position wherein the second latch tongue does not engage the second catch, the second catch disposed in one of the top portion or the body portion of the third door panel, the second latch tongue disposed in the other of the top portion or the body portion of the third door panel, and the fourth magnet disposed in the second door panel, and wherein the third magnet has a third magnetic field and the fourth magnet has a fourth magnetic field;

d. wherein when the third door panel is substantially alongside the second door panel, the fourth magnet is positioned proximate the third magnet and the fourth magnetic field of the fourth magnet interacts with the third magnetic field of the third magnet to move the second latch tongue to the second position, and when the third door panel is not substantially alongside the second door panel, the third magnetic field of the third magnet does not interact with the fourth magnetic field of the fourth magnet and the second latch tongue is in the first position.

6. The door system of claim 1, further comprising:

a. a second latch assembly affixed to a portion of one of the first door panel or the second door panel, the second latch assembly having a second catch associated with a first plate, a second latch tongue associated with a second plate, the first plate pivotally interconnected to the first door panel and the second door panel and configured to pivot relative to the second plate, the second plate mounted to the one of the first door panel or the second door panel to which the second latch assembly is affixed, and a third magnet associated with the second latch tongue, the third magnet having a third magnetic field, the second latch tongue moveable between a first position and a second position, and wherein when the second latch tongue is in the first position the second latch tongue engages the second catch and prevents the first plate from pivoting relative to the second plate and the first plate maintains a first predetermined spacing between the first door panel and the second door panel, and when the second latch tongue is in the second position the second latch tongue disengages the second catch, the first plate is able to pivot relative to the second plate and the first door panel is configured to separate from the second door panel up to a second predetermined spacing greater than the first predetermined spacing;

b. a fourth magnet disposed within a portion of the other of the first door panel or the second door panel, the fourth magnet having a fourth magnetic field;

c. wherein, when the second door panel is in the second position, the third magnetic field of the third magnet does not overlap with the fourth magnetic field of the fourth magnet, the second latch member is in the first position and the first plate cannot pivot relative to the second plate, and when the second door panel is in the first position the third magnet is proximate the fourth magnet and the third magnetic field of the third magnet overlaps with the fourth magnetic field of the fourth magnet causing the second latch tongue to move to the second position.

7. The door system of claim 6, wherein the first door panel and the second door panel each have a bottom edge, and the second latch assembly is affixed proximate the bottom edge of the one of the first door panel or the second door panel.

8. The door system of claim 6, wherein the first, second, third and fourth magnets are positioned such that the first magnetic field of the first magnet and the second magnetic field of the second magnet overlap at approximately the same time the third magnetic field of the third magnet overlaps with the fourth magnet field of the fourth magnet.

9. The door system of claim 6, further comprising a second biasing member for biasing the second latch tongue in the first position.

10. A door package, comprising:

a. a door frame having a top portion, a first jamb connected to a first end of the top portion, and a second jamb connected to a second end of the top portion, the top portion including one or more tracks operable to slideably engage with at least one door panel of a door assembly, the top portion, first jamb and second jamb defining a plane of the door frame;

b. a door assembly comprising two or more door panels, wherein each door panel of the two or more door panels has a first vertical edge and a second vertical edge, wherein at least a first door panel of the two or more door panels is attached to the door frame, and a second door panel of the two or more door panels is slideably engaged with one of the one or more tracks of the top portion of the door frame and movable between a first position with the first vertical edge of the second door panel proximate the first jamb and a second position with the second vertical edge of the second door panel extending beyond the second vertical edge of the first door panel, and wherein the door assembly has a first open position wherein the first vertical edge of each of the two or more door panels is positioned proximate the first door jamb and each of the two or more door panels are positioned parallel with the plane of the door frame;

c. a pivot plate configured to connect to a floor at a position proximate the first door jamb and to pivotally engage with the two or more door panels and to allow the two or more door panels to pivot away from the plane of the door frame when the two or more door panels are in the first open position;

d. a first latch assembly associated with the second door panel, the first latch assembly having a first catch member and a first latch member, wherein the first latch member is movable between a first position and a second position, and when the first latch member is in the first position the first catch member prevents pivoting movement of the second door panel, and when the first latch member is in the second position the first catch member does not prevent pivoting movement of the second door panel;

e. an actuator comprising a first member and a second member, the first member associated with the first latch member and the second member associated with the first door panel, wherein when the door assembly is in the open position, the location of the second member relative to the first member causes the first latch member to move to the second position and the door assembly is operable to pivot to a broken open position that is substantially perpendicular to the plane of the door frame.

11. The door package of claim 10, wherein the first member and second member of the actuator are magnets.

12. The door package of claim 10, wherein the first member comprises one of magnetic or ferrous material and the second member comprises the other of magnetic or ferrous material.

13. The door package of claim 10, further comprising a swing arm pivotally attached to the first door panel and the second door panel, the swing arm having a locked position in which the first and second door panels are kept at a first predetermined distance from each other, and an unlocked position in which the first and second door panels are prevented from separating more than a second predetermined distance while the door assembly is pivoting from the first open position to the broken open position.

14. The door package of claim 10, wherein the pivot plate comprises a vertical pin for each of the two or more door panels, the pins being operable to temporarily or permanently engage with each of the two or more door panels when the two or more door panels are in the first open position and to provide an axis around which each of the two or more door panels can rotate as the two or more door panels are pivoted to the broken open position.

15. The door package of claim 14, further comprising a pivot block mounted on the second door panel of the two or more door panels, the pivot block engaging with the pivot plate when the second door panel pivots between the first open position to the broken open position.

16. The door package of claim 10, wherein at least one of the two or more door panels includes a transparent portion.

17. The door package of claim 10, wherein the door assembly comprises a telescopic door having three door panels.

18. A door package comprising:

a. an upper frame portion having one or more tracks, wherein each track has a first end and a second end and the first end of each of the one or more tracks is located proximate to the other of the first ends of the one or more tracks, and the second end of each of the one or more tracks is located proximate to the other of the second ends of the one or more tracks;

b. a first carriage slideably interconnected to a first track of the one or more tracks;

c. a first door panel pivotally interconnected to the first carriage and movable relative to the first carriage between a first locked position wherein the first door panel is parallel with the first track and a second unlocked position wherein the first door panel is oriented at an angle relative to the first track, the first door panel movable with the first carriage between a retracted position proximate the first end of the first track and an extended position remote from the first end of the first track;

d. a second non-sliding door panel pivotally mounted to the upper frame portion proximate the first end of the first track of the one or more tracks;

e. a first latch assembly having a first catch member affixed at a first location to one of the first carriage or the first door panel, a first latch member affixed at a second location to the other of the first carriage or the first door panel wherein the first latch member is adjacent the first catch member when the first door panel and the first carriage are in the first locked position, and a first magnet associated with the first latch member, the first magnet having a first magnetic field, wherein the first latch member is movable between a first position and a second position and is biased to the first position, and wherein when the first latch member is in the first position the first catch member prevents the first door panel from pivoting relative to the first carriage, and when the first latch member is in the second position the first catch member does not prevent the first door panel from pivoting relative to the first carriage;

f. a second magnet disposed within the second non-sliding door panel, the second magnet having a second magnetic field;

g. wherein, when the first door panel is in the extended position, the first magnetic field of the first magnet does not overlap with the second magnetic field of the second magnet and the first latch member is in the first position, and when the first door panel is in the retracted position the first magnet is proximate the second magnet and the first magnetic field of the first magnet overlaps with the second magnetic field of the second magnet causing the first latch member to move to the second position whereby the first door panel can pivot relative to the first carriage and the second door panel can pivot relative to the first track of the upper frame portion.

19. The package of claim 18, wherein the first latch member is biased to the first position by at least one of a spring or gravity.

20. The package of claim 18, further comprising a. a second carriage slideably interconnected to a second track of the one or more tracks;

b. a third door panel pivotally interconnected to the second carriage and movable with the second carriage between a first retracted position wherein the third door panel is adjacent the first door panel when the first door panel is in the retracted position and a second extended position extending beyond the extended position of the first door panel, and wherein the third door panel is interconnected to the first door panel and slides relative to the first door panel, and when the first door panel is in the retracted position and the third door panel is in the first retracted position the second non-sliding door panel and the first and third door panels are configured to simultaneously pivot relative to the one or more tracks.

21. The package of claim 18, further comprising a pivot plate engageable with a floor and with the first door panel and the second non-sliding door panel, and wherein the first door panel and the second non-sliding door panel pivot about the pivot plate.

22. The package of claim 18, further comprising:

a. a second latch assembly affixed to a portion of one of the first door panel or the second non-sliding door panel, the second latch assembly having a second catch member associated with a first plate, a second latch member associated with a second plate, the first plate pivotally interconnected to the first door panel and the second non-sliding door panel and configured to pivot relative to the second plate, the second plate mounted to the one of the first door panel or the second non-sliding door panel to which the second latch assembly is affixed, and a third magnet associated with the second latch member, the third magnet having a third magnetic field, the second latch member moveable between a first position and a second position, and wherein when the second latch member is in the first position the second latch member engages the second catch member and prevents the first plate from pivoting relative to the second plate and the first plate maintains a first predetermined spacing between the first door panel and the second non-sliding door panel, and when the second latch member is in the second position the second latch member disengages the second catch member, the first plate is able to pivot relative to the second plate and the first door panel is configured to separate from the second non-sliding door panel up to a second predetermined spacing greater than the first predetermined spacing;

b. a fourth magnet disposed within a portion of the other of the first door panel or the second non-sliding door panel, the fourth magnet having a fourth magnetic field;

c. wherein, when the first door panel is in the extended position, the third magnetic field of the third magnet does not overlap with the fourth magnetic field of the fourth magnet, the second latch member is in the first position and the first plate cannot pivot relative to the second plate, and when the first door panel is in the retracted position the third magnet is proximate the fourth magnet and the third magnetic field of the third magnet overlaps with the fourth magnetic field of the fourth magnet causing the second latch member to move to the second position.

23. The package of claim 22, wherein the first, second, third and fourth magnets are positioned such that the first magnetic field of the first magnet and the second magnetic field of the second magnet overlap at approximately the same time the third magnetic field of the third magnet overlaps with the fourth magnet field of the fourth magnet.

24. The package of claim 22, wherein the second latch member is biased to the first position by at least one of a spring or gravity.

25. The package of claim 22, wherein when the second plate pivots relative to the first plate the first door panel is operable to separate from the second non-sliding door panel.

26. The door package of claim 18, further comprising:

a. a second carriage slideably interconnected to a second track of the one or more tracks;

b. a third door panel pivotally interconnected to the second carriage and movable relative to the second carriage between a first locked position wherein the third door panel is parallel with the second track and a second unlocked position wherein the third door panel is oriented at an angle relative to the second track, the third door panel movable with the second carriage between a retracted position proximate the first end of the second track of the one or more tracks and an extended position beyond the extended position of the first door panel;

c. a second latch assembly having a second catch member affixed at a first location to one of the second carriage or the third door panel, a second latch member affixed at a second location to the other of the second carriage or the third door panel wherein the second latch member is adjacent the second catch member when the third door panel and the second carriage are in the locked position, and a third magnet associated with the second latch member, the third magnet having a third magnetic field, wherein the second latch member is movable between a first position and a second position and is biased to the first position, and wherein when the second latch member is in the first position the second catch member prevents the third door panel from pivoting relative to the second carriage, and when the second latch member is in the second position the second catch member does not prevent the third door panel from pivoting relative to the second carriage;

d. a fourth magnet affixed to the one of the first door panel or the first carriage, the fourth magnet having a fourth magnetic field;

e. wherein, when the third door panel is in the extended position, the third magnetic field of the third magnet and the fourth magnetic field of the fourth magnet do not overlap and the second latch member is in the first position, and when the third door panel is in the retracted position the third magnet of the second latch assembly is proximate the fourth magnet of the second latch assembly and the third magnetic field of the third magnet overlaps with the fourth magnetic field of the fourth magnet wherein the first latch member of the second latch assembly moves to the second position and the third door panel can pivot relative to the second track of the upper frame portion.

27. The package of claim 26, wherein the first door panel and the second non-sliding door panel each have a bottom edge, and the second latch assembly is affixed proximate the bottom edge of the one of the first door panel or the second non-sliding door panel.

28. The package of claim 26, further comprising:

a. a third latch assembly affixed to a portion of one of the first door panel or the third door panel, the third latch assembly having a third catch member associated with a third plate, a third latch member associated with a fourth plate, the third plate pivotally interconnected to the first door panel and the third door panel and configured to pivot relative to the fourth plate, the fourth plate mounted to the one of the first door panel or the third door panel to which the third latch assembly is affixed, and a fifth magnet associated with the third latch member, the fifth magnet having a fifth magnetic field, the third latch member moveable between a first position and a second position, and wherein when the third latch member is in the first position the third latch member engages the third catch member and prevents the third plate from pivoting relative to the fourth plate and the third plate maintains a first predetermined spacing between the first door panel and the third door panel, and when the third latch member is in the second position the third latch member disengages the third catch member, the third plate is able to pivot relative to the fourth plate and the first door panel is configured to separate from the third door panel up to a second predetermined spacing greater than the first predetermined spacing;

b. a sixth magnet disposed within a portion of the other of the first door panel or the third door panel, the sixth magnet having a sixth magnetic field;

c. wherein, when the third door panel is in the extended position, the fifth magnetic field of the fifth magnet does not overlap with the sixth magnetic field of the sixth magnet, the third latch member is in the first position and the third plate cannot pivot relative to the fourth plate, and when the third door panel is in the retracted position the fifth magnet is proximate the sixth magnet and the fifth magnetic field of the fifth magnet overlaps with the sixth magnetic field of the sixth magnet causing the third latch member to move to the second position.

29. The package of claim 28, wherein the first door panel and the third door panel each have a bottom edge, and the third latch assembly is affixed proximate the bottom edge of the one of the first door panel or the third door panel.

30. A door system comprising:

a. A frame portion having a proximal end and a distal end including at least one track extending between the proximal end and the distal end;

b. A first carriage slideably interconnected to a first track of the at least one track;

c. A first non-sliding door panel having a first vertical edge and a second vertical edge spaced from the first vertical edge, the first non-sliding door panel pivotally affixed to the frame portion, wherein the pivot is proximate the first vertical edge and the proximal end of at least one track;

d. A second door panel pivotally interconnected to the first carriage, the second door panel having a first vertical edge and a second vertical edge spaced from the first vertical edge, the first carriage and second door panel movable together between a first position proximate the first end wherein the first vertical edge of the second door panel is proximate the first vertical edge of the first non-sliding door panel and a second position wherein the second vertical edge of the second door panel extends beyond the second vertical edge of the first non-sliding door panel;

e. A first latch assembly locking the position of the second door panel relative to the first carriage, the first latch assembly including a first component affixed to the first carriage and a second component affixed to the second door panel, the first latch assembly having a first locked position wherein the first component engages the second component and a second unlocked position wherein the first component and second component are disengaged, the first lock assembly biased to the locked position;

f. A first actuator affixed to the first non-sliding door panel and configured to cause the first and second components of the first latch assembly to disengage when the second door panel is in the first position.

31. The door system of claim 30, wherein the first actuator comprises a first magnet with a first magnetic field and the first latch assembly further comprises a ferrous member or second magnet with a second magnetic field, wherein the first magnet is proximate the ferrous member or the second magnet the first magnetic field interacts with the ferrous member or the second magnetic field to cause the first component and the second component of the first latch assembly to disengage.

32. The door system of claim 30, wherein the first component and second component of the first latch assembly comprise an electromechanical lock having an engaged and a disengaged position, and the first actuator comprises an optical sensor configured to sense when the second door panel is in the first position and send a first signal, and a controller to receive the first signal from the sensor and to send a second signal to the electromechanical lock to disengage the first component and the second component.

* * * * *